US006293640B1

(12) United States Patent
Narushima

(10) Patent No.: US 6,293,640 B1
(45) **Date of Patent: *Sep. 25, 2001**

(54) PRINTING APPARATUS AND PRINTING METHOD

(75) Inventor: Toshio Narushima, Kanagawa (JP)

(73) Assignee: Sony Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/885,755

(22) Filed: Jun. 30, 1997

(30) Foreign Application Priority Data

Jul. 3, 1996 (JP) ..... P08-173325

(51) Int. Cl.[7] ..... B41J 29/38; B41J 2/21; B41J 29/393

(52) U.S. Cl. ..... 347/12; 347/43; 347/19

(58) Field of Search ..... 347/12, 43, 19, 347/7, 37, 41, 42

(56) References Cited

U.S. PATENT DOCUMENTS 4,540,996 * 9/1985 Saito ..... 347/43

* cited by examiner

*Primary Examiner*—John Barlow
*Assistant Examiner*—Charles W. Stewart, Jr.
(74) *Attorney, Agent, or Firm*—Sonnenschein, Nath & Rosenthal

(57) ABSTRACT

Disclosed are a printing apparatus and a printing method which can prevent a deterioration in printing image quality when printing is executed on a time-division basis while performing scanning continuously with a printer head.

In a two-liquid mixing type ink jet printer which performs printing in halftone by mixing a determined amount of ink with a fixed amount of diluent, when printing is executed through interleaving operation by driving on a time-division basis each determination side electrostrictive element 309 and each ejection side electrostrictive element 310 of a group of nozzles provided on a recording head, the nozzles are divided into groups driven with same ejection timing and the ejection timing between the groups is determined such that the printing position for each nozzle ejecting ink is adjacent to the printing positions for those nozzles which are adjacent thereto with respect to the sub-scanning direction, with respect to the main scanning direction, whereby it is possible to make printing misregistration less conspicuous when performing printing while effecting scanning with the printer head 30 in the main scanning direction, thereby making it possible to prevent a deterioration in printing image quality even when an image having a longitudinal line component is printed.

7 Claims, 10 Drawing Sheets

PRINTING APPARATUS AND PRINTING METHOD

BACKGROUND OF THE INVENTION

1. Field of the Invention

The present invention relates to a printing apparatus and a printing method for printing images while performing scanning with a printer head in a main scanning direction with respect to a printing medium.

2. Description of the Related Art

As a known conventional example of a printing apparatus of this type, there exists an ink jet printer, in which a number of nozzles are arranged on the printer head. In this ink jet printer, when ejecting ink by driving aelectrostrictive elements provided behind the nozzles in the printer head, a current of approximately 50 mA flows momentarily in a drive circuit for driving one electrostrictive element.

To cause ink to be ejected simultaneously from a number of nozzles by using such drive circuits, it has been necessary to momentarily supply an enormous consumption current. Thus, there has conventionally been proposed an arrangement in which, to reduce the momentarily required consumption current by supplying current on a time-division basis to each drive circuit in order that a number of electrostrictive elements may be driven without using a power source of a large capacity.

However, when causing ink to be ejected from the nozzles by driving the electrostrictive elements on a time division basis while continuously performing scanning with the printer head, a positional deviation occurs in printing in the ink ejected from the nozzles due to a difference in drive timing between the electrostrictive elements, resulting in a deterioration in image quality. This is particularly conspicuous in the case of the printing of an image having a longitudinal line component.

SUMMARY OF THE INVENTION

In view of the above problem, it is an object of the present invention to provide a printing apparatus and a printing method which can prevent a deterioration in print quality when printing on a time-division basis while performing scanning continuously with the printer head.

To achieve the above object, there is provided, in accordance with claim 1 of the present invention, a printing apparatus of the type in which scanning is performed with a printer head in a main scanning direction with respect to a printing material to thereby print an image, wherein N recording elements are arranged on the printer head in a sub-scanning direction at intervals of K dots such that K/N is an irreducible fraction, and wherein there is provided a grouping means which, when printing is effected by driving the above-mentioned recording elements while effecting an interlaced scanning with the above-mentioned printer head for each predetermined dot interval, divides the above-mentioned recording elements into groups each consisting of recording elements driven with the same timing and determines the drive sequence for these groups such that the printing position on the above-mentioned recording material for a given recording element is, with respect to the main scanning direction, the same as or adjacent to the printing positions for those recording elements which are adjacent to that recording element with respect to the sub-scanning direction.

It is desirable that the above-mentioned printer head be equipped with a plurality of recording heads, each recording head being equipped with the above-mentioned recording elements of cyan, magenta and yellow, or the above-mentioned recording elements of cyan, magenta, yellow and black. Further, it is desirable for the above-mentioned grouping means to effect the above-mentioned division into groups and determine the above-mentioned drive sequence such that the case is included in which the printing position for the above-mentioned given recording element is, with respect to the main scanning direction, close to the printing position for those recording elements adjacent thereto in the sub-scanning direction. Further, the present invention is applicable to a two liquid mixing type ink jet printer in which ink and diluent are mixed with each other before being ejected from a nozzle, wherein it is desirable that the above-mentioned recording elements be equipped with ejection means for ejecting the above-mentioned mixture ink from the above-mentioned nozzles and determination means for providing a determined amount of the above-mentioned ink. Further, it is desirable that the present invention be applicable to a head scanning type on-demand printing apparatus in which the above-mentioned printer head moves in the main scanning direction with respect to the above-mentioned recording material. Further, it is desirable that the above-mentioned recording elements be driven during the forward and backward movements of the above-mentioned printer head.

In accordance with claim 7 of the present invention, there is provided a printing method of the type in which scanning is performed with a printer head in a main scanning direction with respect to a printing material to thereby print an image, wherein N recording elements are arranged on the printer head in a sub-scanning direction at intervals of K dots such that K/N is an irreducible fraction, and wherein when the above-mentioned recording elements are driven while effecting an interlaced scanning with the above-mentioned printer head for each predetermined dot interval, the above-mentioned recording elements are divided into groups each consisting of recording elements driven with the same timing and the drive sequence for these groups is determined such that the printing position on the above-mentioned recording for a given recording element is, with respect to the main scanning direction, the same as or adjacent to the printing positions for those recording elements which are adjacent to that recording element with respect to the sub-scanning direction.

DESCRIPTION OF THE PREFERRED EMBODIMENTS

A printing apparatus according to an embodiment of the present invention will now be described. The printing apparatus of this embodiment is applicable to a two liquid mixing type ink jet printer (carrier jet printer).

First, the ink ejection mechanism of a carrier ink jet printer will be described. In a carrier jet printer, a predetermined amount of ink is mixed with a predetermined amount of diluent to thereby effect printing in halftone.

Figure 2A:
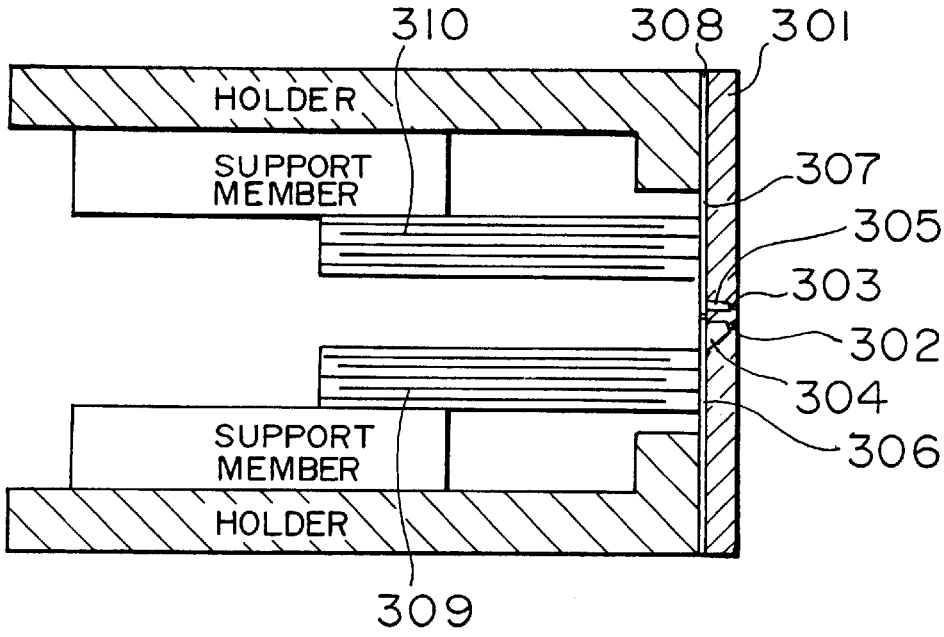
FIG. 2 is a sectional view showing an ink ejection mechanism.
Figure 2B:
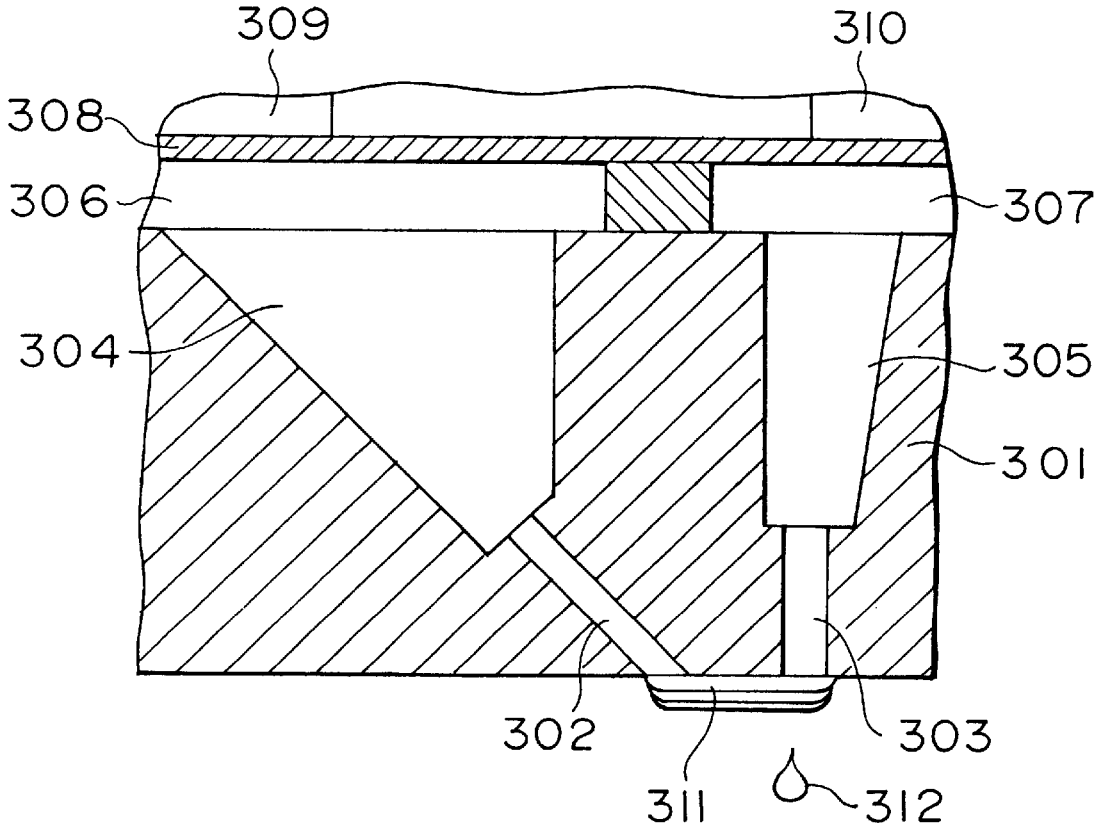

FIGS. 2A and 2B are sectional views showing an ink ejection mechanism. FIG. 2A shows the general-construction of the mechanism, and FIG. 2B shows the construction of an essential part thereof. An orifice plate 301 is provided with a determination side nozzle 302 and an ejection side nozzle 303. Connected to the back side of these nozzles 302 and 303 are an ink inlet 304 and a diluent inlet 305, respectively.

These inlets 304 and 305 communicate with a determination side cavity 306 and an ejection side cavity 307, respectively, and an oscillation plate 308 is provided behind the cavities 306 and 307. The oscillation plate 308 is driven by a determination side electrostrictive element 309 and an ejection side electrostrictive element 310.

Figure 3A:
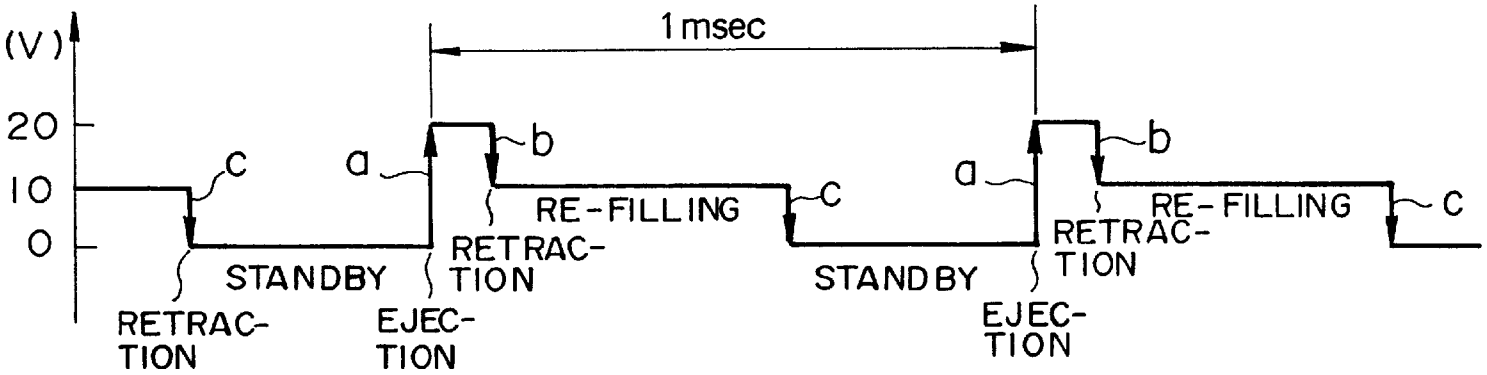
FIGS. 3A and 3B are timing charts showing drive signals supplied to a determination side electrostrictive element 309 and an ejection side electrostrictive element 310.
Figure 3B:
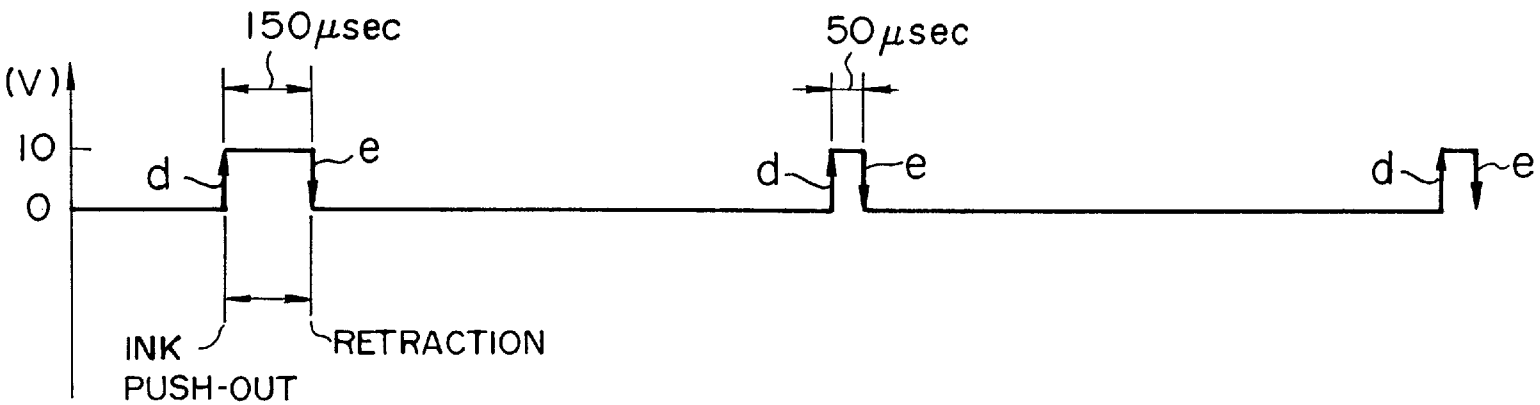

FIGS. 3A and 3B are timing charts showing drive signals supplied to the determination side electrostrictive element 309 and the ejection side electrostrictive element 310. FIG. 3A shows the drive signal supplied to the ejection side electrostrictive element 310. By causing a great displacement of the electrostrictive element 310 at a point in time a, the diluent filling the diluent inlet 305 is ejected from the ejection side nozzle 303. At points in time b and c, the ejection side electrostrictive element 310 is retracted, and the diluent inlet 305 is again filled with diluent from the ejection side cavity 307.

FIG. 3B shows the drive signal supplied to the determination side electrostrictive element 309. During the period d~e, ink is pushed out from the nozzle 302, and the ink 311 thus pushed out remains on the front side of the ejection side nozzle 303. When diluent is ejected from this ejection side nozzle 303, the diluent droplet 312 is mixed with ink in an amount corresponding to the thickness of the ink layer 311.

The ejection, executed at point in time a, is effected, for example, at an interval of 1 msec. At this time, a voltage, for example, of 0~20 V is applied to the ejection side electrostrictive element 310, and diluent is ejected by the mechanical displacement of the ejection side electrostrictive element 310 due to the voltage applied. At point in time d, a voltage, for example, of 0~10 V is applied to the determination side electrostrictive element 309. However, no ejection of ink is caused by the displacement of the electrostrictive element 309 due to this voltage, ink being just pushed out from the forward end of the nozzle 302.

By utilizing the length of the period d~e and the voltage value, it is possible to control the thickness of the ink layer 311 formed by being pushed out on the front surface of the ejection side nozzle 303 and remaining there, and the ink concentration of the droplet 312 ejected can be arbitrarily controlled. That is, in accordance with the print information, the length of the period d~e and the voltage value are controlled so as to be, for example, 150gsec and 10 V; and 50 gsec. and 10 V, whereby it is possible to effect printing in an arbitrary halftone.

Figure 1:
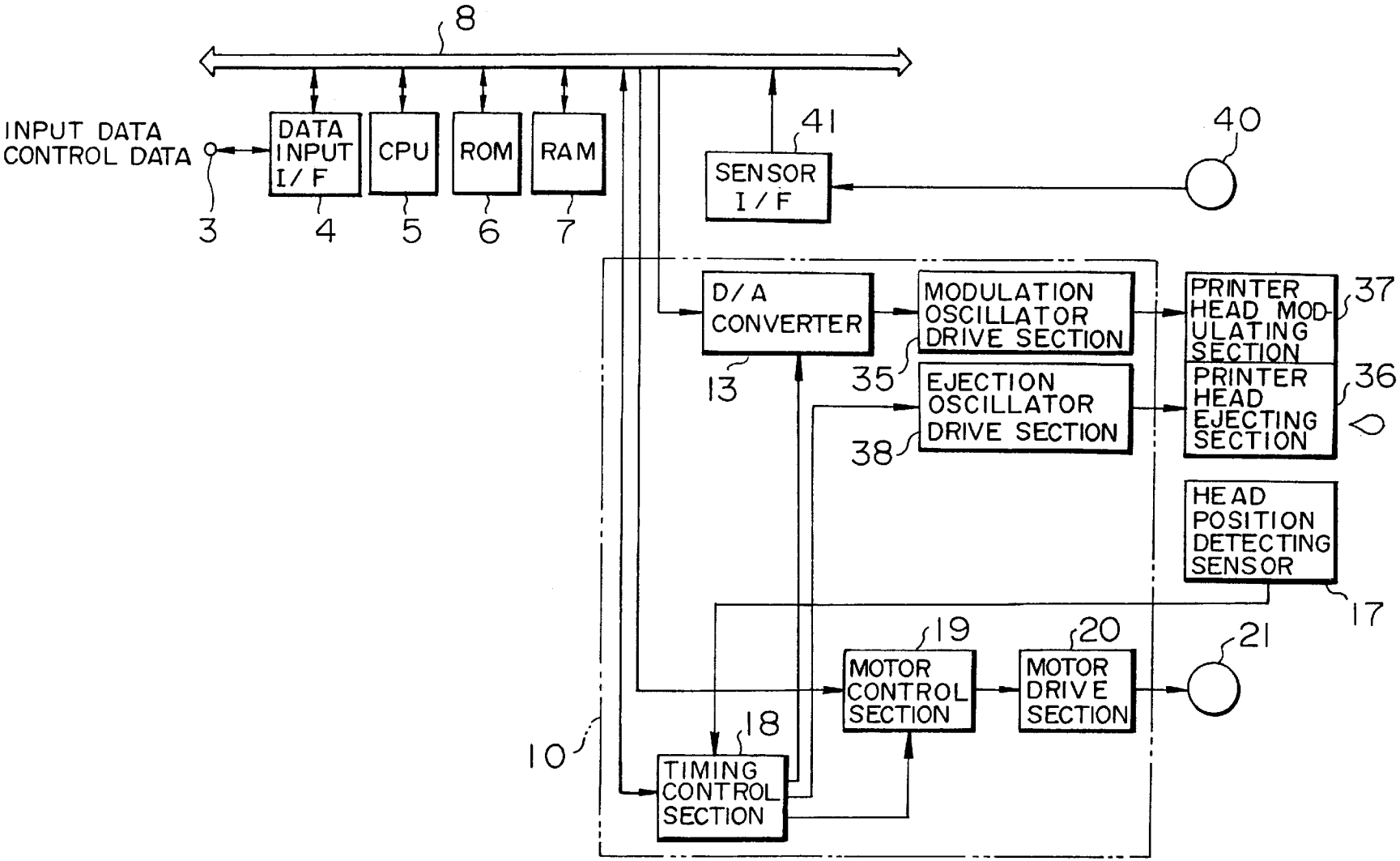
FIG. 1 is a block diagram showing the construction of the control section of a carrier jet printer.

The construction of the control section of a carrier jet printer having the above-described ink ejection mechanism will be described. FIG. 1 is a block diagram showing the construction of the control section of a carrier jet printer. A carrier jet printer 1 includes a data input interface (I/F) 4, a CPU 5, a ROM 6, a RAM 7, a sensor I/F 41 and a printer driving circuit 10. These components are connected to a system bus 8.

The data input I/F 4 supplies input data, control data, etc. from a host computer (not shown) to the system bus 8. The data input I/F may consist of a parallel interface such as centronics or SCSI, or a serial interface such as RS232C or RS422.

The printer driving circuit 10 is provided with a D/A converter 13, a timing control section 18, a motor control section 19, a motor drive section 20, a modulation oscillator drive section 35, and an ejection oscillator drive section 38. A printer head modulating section 37 is connected to the modulation oscillator drive section 35, and a printer head ejecting section 36 is connected to the ejection oscillator drive section 38. The printer head modulating section 37 and the printer head ejecting section 36 are provided with the above-mentioned determination side electrostrictive element 309 and the ejection side electrostrictive element 310, respectively.

Although only the portion corresponding to one nozzle is shown in the printer driving circuit 10 of FIG. 1 in order to facilitate the understanding, the nozzles arranged on the printer head are in reality divided into groups as described below, the nozzles in each group being provided with a D/A converter 13, a modulation oscillator drive section 35, a printer head modulating section 37 and a printer head ejecting section 36 corresponding to each nozzle in order that ink may be ejected with the same ejection timing (See FIG. 9).

A head position detecting sensor 17 is connected to the timing control section 18, and a paper feeding motor and a head feeding motor 21 are connected to the motor drive section 20. Further, a temperature sensor 40 provided in the vicinity of the nozzles of the printer head is connected to the sensor I/F 41.

The CPU 5 inputs a printing data signal supplied from a host computer (not shown) through the data input I/F 4 to the D/A converter 13 through the system bus 8. The D/A converter 13 converts the printing data signal, which is a digital signal, into a modulation oscillator drive signal, which is an analog signal, and outputs it to the modulation oscillator drive section 35. The modulation oscillator drive section 35 outputs a modulation oscillator application signal and drives the printer head modulating section 37 to measure an amount of ink corresponding to the printing data signal.

The timing control section 18 outputs a motor drive trigger signal to the motor control section 19. The motor control section 19 inputs a motor drive control signal from the CPU 5 through the system bus 8, and then outputs a motor drive signal to the motor drive section 20 to drive the paper feeding motor and the head feeding motor 21. The timing control section 18 inputs a position detecting signal from the head position detecting sensor 17 and performs the positioning of the printer head.

Figure 4:
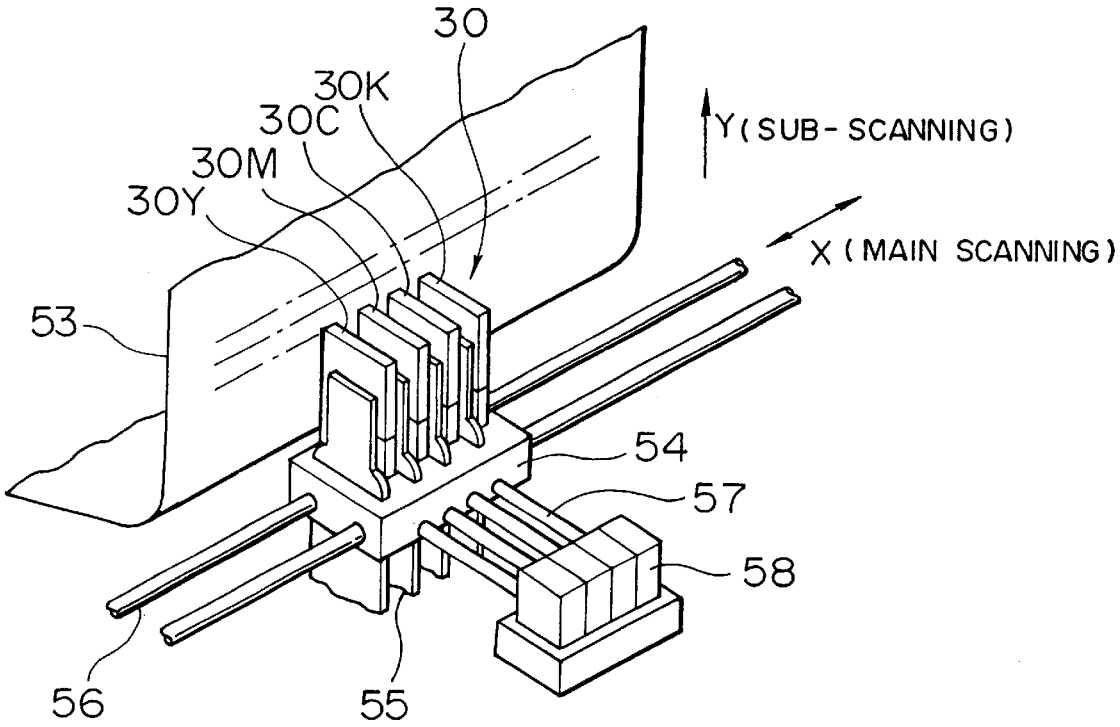
FIG. 4 is a perspective view showing the construction of a printer head and peripheral components.

FIG. 4 is a perspective view showing the construction of a printer head the peripheral components. A printer head 30 according to this embodiment is composed of a yellow (Y) recording head 30Y, a magenta (M) recording head 30M, a cyan (C) recording head 30C and a black (BK) recording head 30K.

There are provided a carriage unit 54 which makes a forward or backward movement in the X (main scanning) direction with the printer head 30 mounted thereon, flexible printed circuit boards 55 for supplying printing data to the carriage unit 54, guide rails 56 for guiding the carriage unit 54, and an ink tank group 58 for supplying inks to the recording heads 30Y, 30M, 30C and 30K through ink supplying pipes 57.

The ink tank group 58 supplies inks to the recording heads 30Y, 30M, 30C and 30K through ink supplying pipes 57. The recording heads 30Y, 30M, 30C and 30K select inks of the different colors on the basis of the printing data supplied from a control circuit (not shown) through the flexible printed circuit boards 55 and eject them onto a recording paper 53 to print a color image. The carriage unit 54, on which the printer head 30 is mounted, is driven by a pulse motor (not shown) and makes a forward or backward movement at one-dot interval.

When the forward or backward movement for one scanning has been completed, the recording paper 53 is fed by a paper feeding mechanism (not shown) by a dot interval corresponding to the nozzle interval of the printer head 30, whereby the printer head 30 performs interlaced scanning (interleaving operation) with respect to the recording paper 53, and the other nozzles move likewise.

Figure 5:
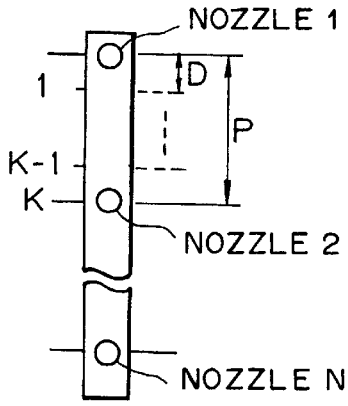
FIG. 5 illustrates a nozzle group arranged on a printer head.

FIG. 5 illustrates a nozzle group arranged on a printer head. In each of the recording heads 30Y, 30M, 30C and 30K, N nozzles 1~N are arranged at intervals of K dots (D dot interval) in the Y (sub-scanning) direction such that K/N is an irreducible fraction, that is, the nozzle interval P=K×D.

Figure 6:
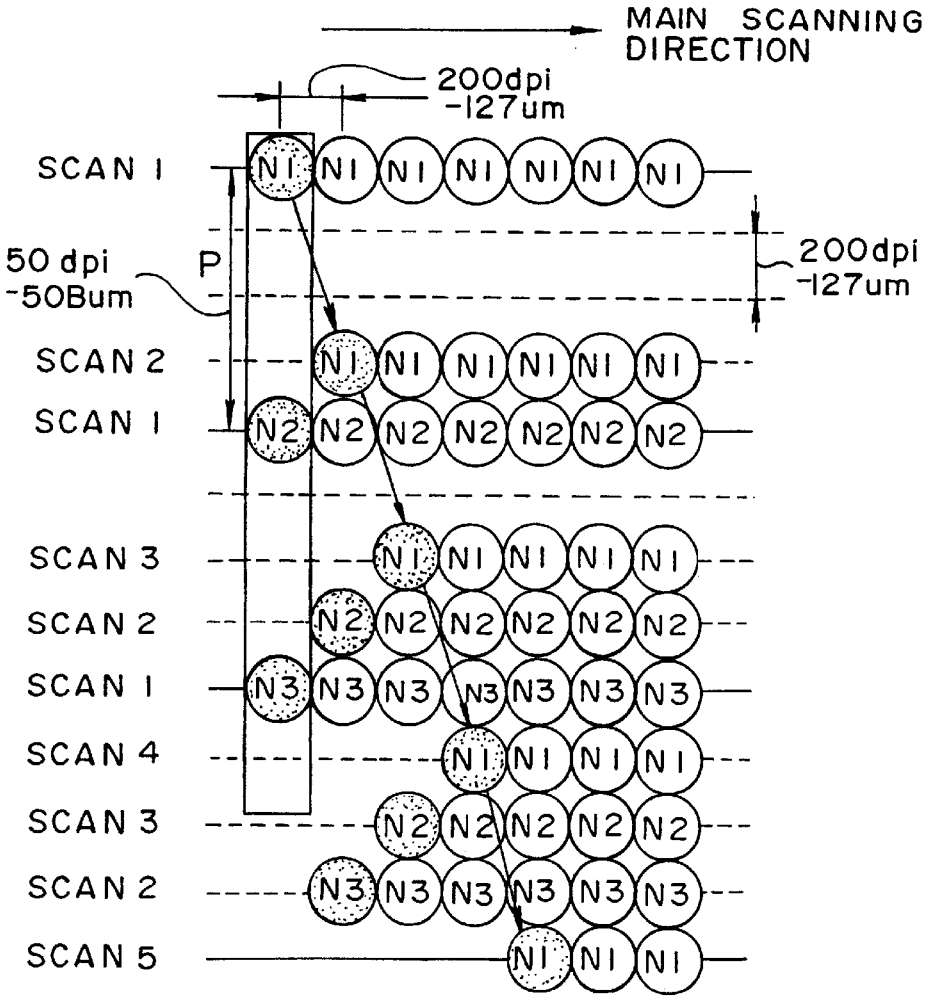
FIG. 6 illustrates printing positions for a nozzle group arranged on a printer head.

FIG. 6 illustrates printing positions of a nozzle group arranged on a printer head. The drawing shows printing positions for one recording head. Further, in order that the ejection start positions for the nozzles may be easily seen, the printing start positions are shifted to the right for each scanning.

Suppose, for example, the dot interval number in the X (main scanning) direction and the Y (sub-scanning) direction is 200 dpi, and the number of nozzles is 3, the scanning being started with Scan 1. The printer head 30 performs scanning by making a forward or backward movement on Scan 1, but ejects no ink at the forward end portion. Then, the recording paper 53 is fed by a paper feeding mechanism (not shown) by a dot interval corresponding to the number of nozzles, that is, by three dots, whereby the printer head 30 performs interlaced scanning (interleaving operation) of 3 dot interval, and the nozzle N1 on Scan 1 moves to Scan 2. The other nozzles move likewise. By repeating this scanning, the nozzle N1 moves to Scan 3, Scan 4 and Scan 5 to effect printing. In this way, the ratio of the number of nozzles N to the dot interval number K in each recording head is an irreducible fraction, so that there is no concern that printing will be overlapped at the same position or that printing failure will occur.

Figure 7:
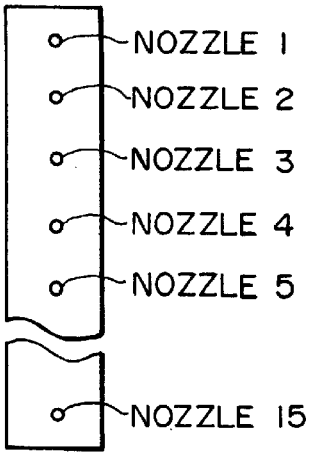
FIG. 7 illustrates a nozzle group of a recording head in which grouping is effected.

Next, the grouping of the nozzles arranged on each recording head will be described. FIG. 7 illustrates a nozzle group of a recording head in which grouping is effected. On the recording head, there are arranged 15 nozzles (N=15) at 4 dot intervals (K=4). When interleaving operation is performed with this recording head, the printing position is determined in the sub-scanning direction on the recording paper 53 in the order: nozzle 5, nozzle 9, nozzle 13, nozzle 2, nozzle 6, nozzle 10, nozzle 14, nozzle 3, nozzle 7, nozzle 11, nozzle 15, nozzle 4, nozzles 8, nozzle 12, and nozzle 1.

Figure 8:
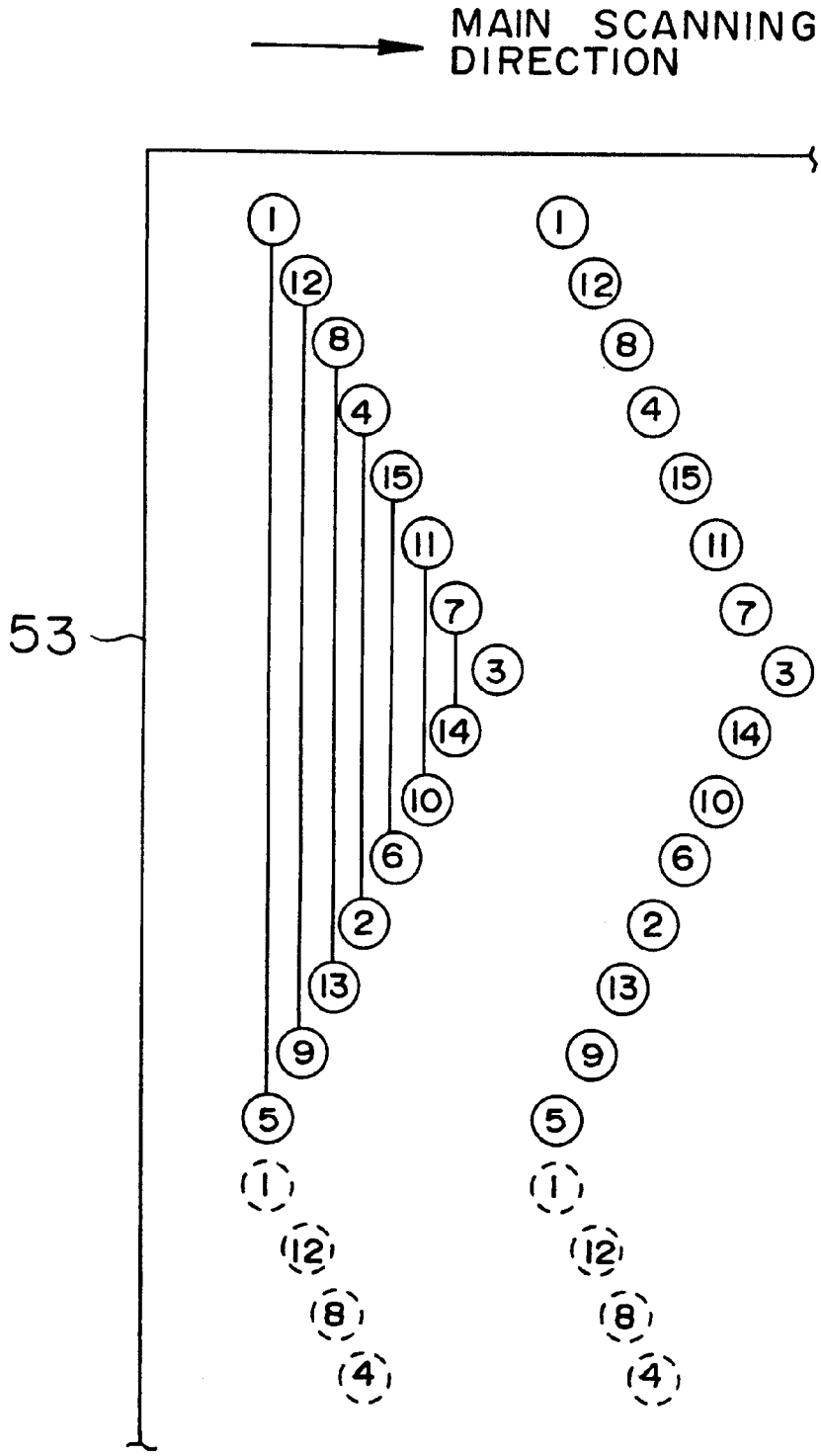
FIG. 8 illustrates the printing position for each nozzle when printing is executed by interleaving operation.

FIG. 8 illustrates the printing position for each nozzle when printing is executed by interleaving operation.

In this embodiment, the nozzles are divided into 8 groups each consisting of nozzles ejecting ink with the same timing. The grouping is effected as follows: a group consisting of nozzle 1 and nozzle 5; a group consisting of nozzle 12 and nozzle 9; a group consisting of nozzle 8 and nozzle 13; a group consisting of nozzle 4 and nozzle 2; a group consisting of nozzle 15 and nozzle 6; a group consisting of nozzle 11 and nozzle 10; a group consisting of nozzle 7 and nozzle 14; and nozzle 3 alone.

When effecting ink ejecting operation in group unit while performing scanning in the main scanning direction with the recording head with respect to the recording paper 53, the group of nozzle 1 and nozzle 5 is the first to eject; the group of nozzle 12 and nozzle 9 is the second to eject; the group of nozzle 8 and nozzle 13 is the third to eject; the group of nozzle 4 and nozzle 2 is the fourth to eject; the group of nozzle 15 and nozzle 6 is the fifth to eject; the group of nozzle 11 and nozzle 10 is the sixth to eject; the group of nozzle 7 and nozzle 14 is the seventh to eject; and nozzle 3 is the eighth to eject. As a result, the printing positions are determined in the form: ">" with respect to the main scanning direction for the recording paper 53 as the recording head moves. In FIG. 8, the shift in printing positions for the nozzles is exaggerated in order to facilitate the understanding.

In this way, the nozzles are grouped and the ejection timing for the groups is determined such that a given printing position on the recording paper 53 for a nozzle is adjacent in the main scanning direction to the nozzles adjacent thereto in the sub-scanning direction, so that it is possible to make any printing misregistration less conspicuous when effecting printing on a time division basis while effecting scanning with the recording head, thereby preventing a deterioration in image quality. In particular, this arrangement is effective when printing an image having a longitudinal line component.

Figure 9:
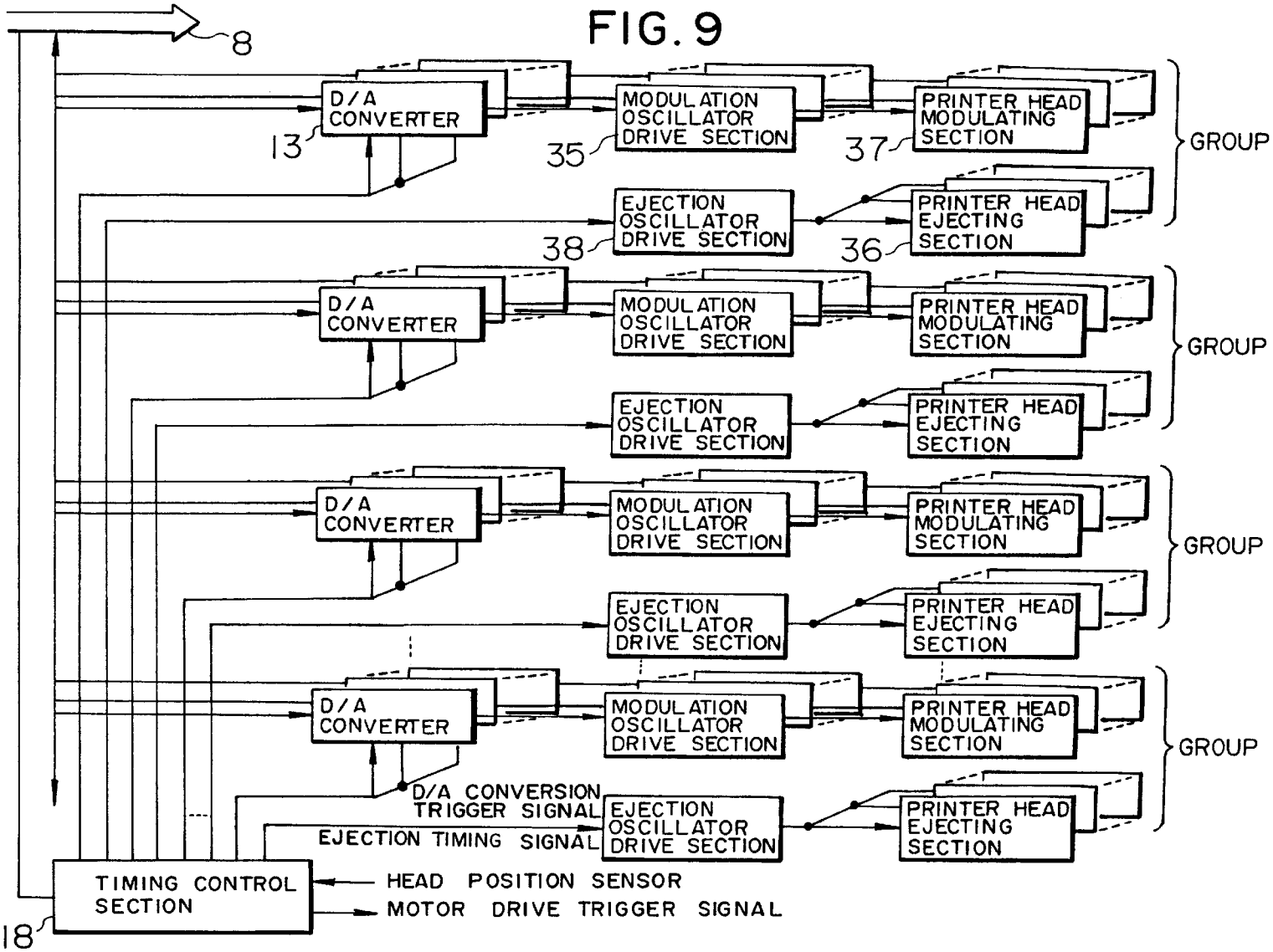
FIG. 9 is a block diagram showing the construction of a printer driving circuit 10 in which a printer head modulating section 37 and a printer head ejecting section 36 are provided for each group.

FIG. 9 is a block diagram showing the construction of a printer driving circuit 10 in which a printer head modulating section 37 and a printer head ejecting section 36 are provided for each group. This printer driving circuit includes D/A converters 13, modulation oscillator drive sections 35, ejection oscillator drive sections 38, printer head modulating sections 37, and printer head ejecting sections 36 for each group in correspondence with the number of nozzles, the whole consisting of 8 groups. When grouping as, is thus effected, a D/A conversion trigger signal is simultaneously supplied to the D/A converters 13 of the groups from the timing control section 18. Only one ejection oscillator drive section 38 is provided for each group.

When a printing control signal from the system bus 8 is supplied to the timing control section 18, and a D/A conversion trigger signal is supplied from the timing control section 18 to the D/A converters 13, the printing data supplied to the D/A converters 13 of the groups from the system bus 8 is converted into arbitrary analog signals. The analog signals thus obtained through conversion are supplied to the respective modulation oscillator drive sections 35.

In the modulation oscillator drive section 35, a modulation signal in which the length of the period d~e and the voltage value have been modulated is formed (See FIG. 3B), and this modulation signal is applied to the printer head modulating section 37 of each group.

Further, an ejection timing signal generated in the timing control section 18 is supplied to the ejection oscillator drive sections 38 (See FIG. 3A). A driving signal from the ejection oscillator driving section 38 is applied to the printer head ejecting section 36 of each nozzle in the group. The timing control section 18 controls the timing of the driving signal such that the periods of voltage variation due to the rise and fall of the determination side driving signal and the ejection side driving signal of the groups do not coincide with each other between the groups. In particular, since the rise of the determination side driving signal varies with the printing data, it is necessary to control the timing such that the fall thereof does not coincide with the rise of the ejection side driving signal in another group.

As described above, in the printing apparatus of this embodiment, when printing is effected by interleaving operation by driving the determination side electrostrictive elements 309 and the ejection side electrostrictive elements 310 on a time division basis, the nozzles are divided into groups each consisting of nozzles driven with the same ejection timing and the order of ejection for the groups is determined such that the printing position for the ink ejected from each nozzle is adjacent in the main scanning direction to the printing positions adjacent thereto in the sub-scanning direction, so that it is possible to make any printing misregistration less conspicuous when performing printing while effecting scanning with the printer head 30 in the main scanning direction, thereby making it possible to prevent a deterioration in printing quality even in the case of the printing of an image having a longitudinal line component.

It is only necessary for the printing positions adjacent to each other in the sub-scanning direction to be close to each other with respect to the main scanning direction. Apart from the case in which the adjacent printing positions are obliquely adjacent to each other as in the above-described embodiment, the case is also acceptable in which the printing positions are-the same with respect to the main scanning direction.

Figure 10:
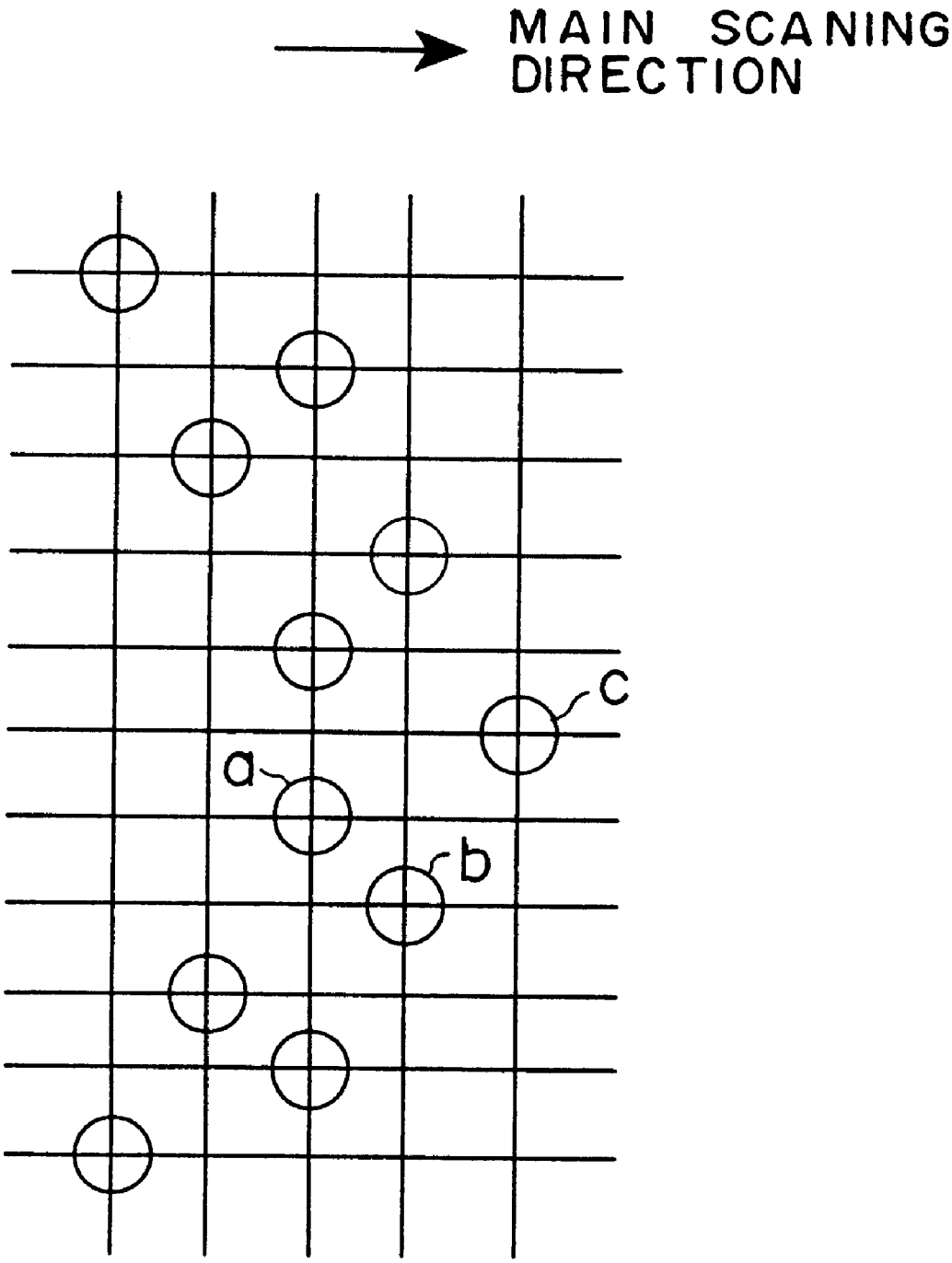
FIG. 10 illustrates another example of printing positions close to each other with respect to the main scanning direction.

FIG. 10 illustrates another example of printing positions closely adjacent in the main scanning direction. In this case, a printing position b adjacent to a predetermined printing position a with respect to the sub-scanning direction is adjacent thereto in the main scanning direction, while a printing position c is somewhat spaced apart therefrom in the main scanning direction. Even in this positional relationship, the distance between two printing positions is not markedly large, so that it is possible to make the printing misregistration less conspicuous.

Further, while in the above-described embodiment grouping is effected on the nozzles of one recording head, it goes without saying that a similar grouping is possible for other recording heads.

Further, while in the above-described embodiment ink is ejected from the nozzles while the printer head makes a forward movement, this invention is naturally also applicable to the case in which ink is ejected while the printer head makes a reciprocative movement. In the case of a reciprocative movement, it is possible to make printing misregistration less conspicuous and increase the printing speed. Further, while in the above-described embodiment the printer head is moved, the present invention is also applicable to the case in which the printer head is stationary and scanning is effected by moving the recording paper in the main scanning direction.

Further, while the above embodiment has been described as applied to a carrier jet printer, it is also applicable to a dot size modulation type ink jet printer.

Figure 11:
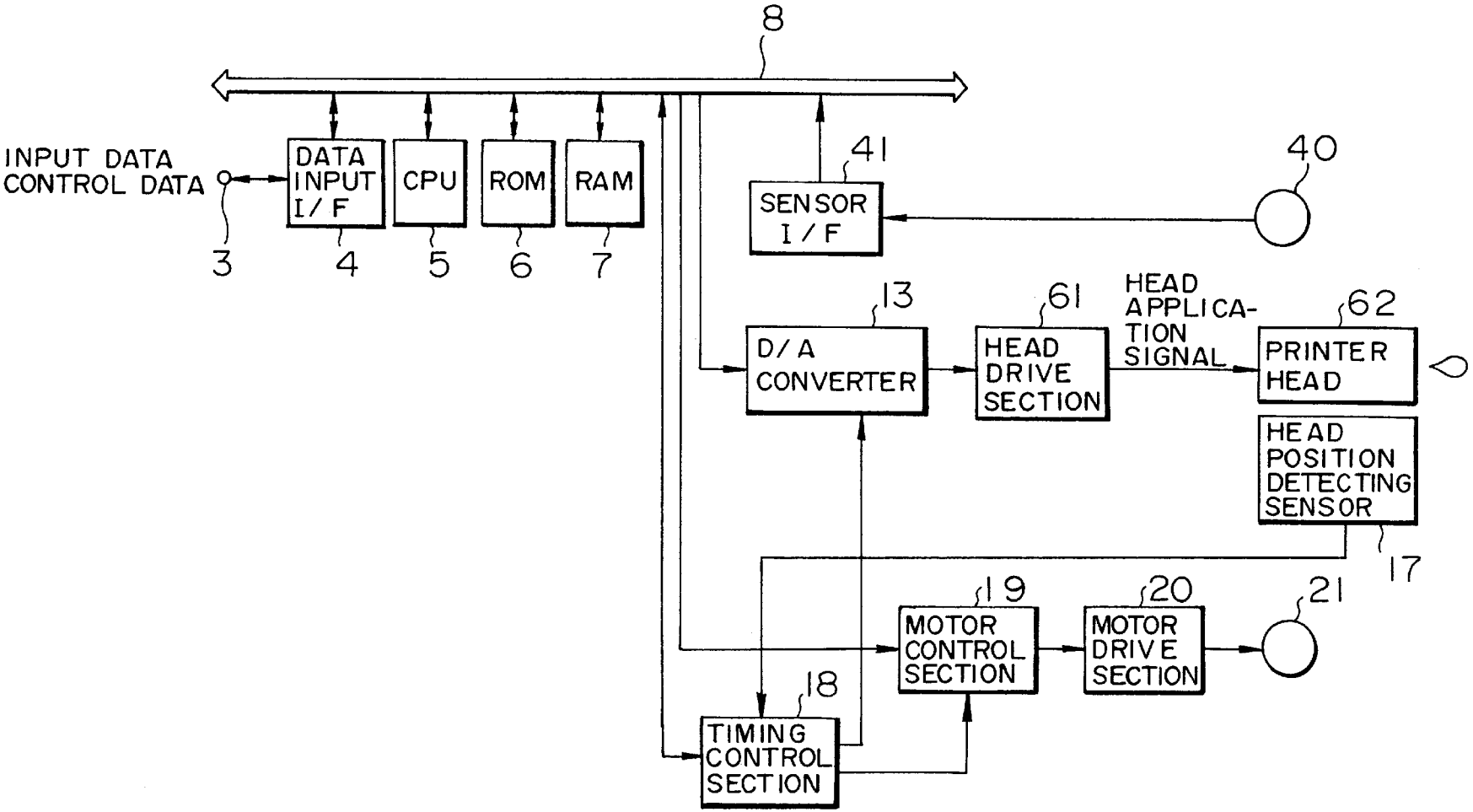
FIG. 11 is a block diagram showing the construction of a dot size modulation type ink jet printer.

FIG. 11 is a block diagram showing the construction of a dot size modulation type ink jet printer. This ink jet printer differs from the carrier jet printer in that, instead of the modulation oscillator drive section 35, the ejection oscillator drive section 38, the printer head modulating section 37 and the printer head ejecting section 36, there are provided a head drive section 61 and a printer head 62. Apart from this, it has the same hardware construction as the carrier jet printer. The dot size modulation type ink jet printer prints in halftone by modulating the ink dot diameter. Further, it allows correction of any variation in ink ejection characteristics due to a variation in ambient temperature.

Figure 12A:
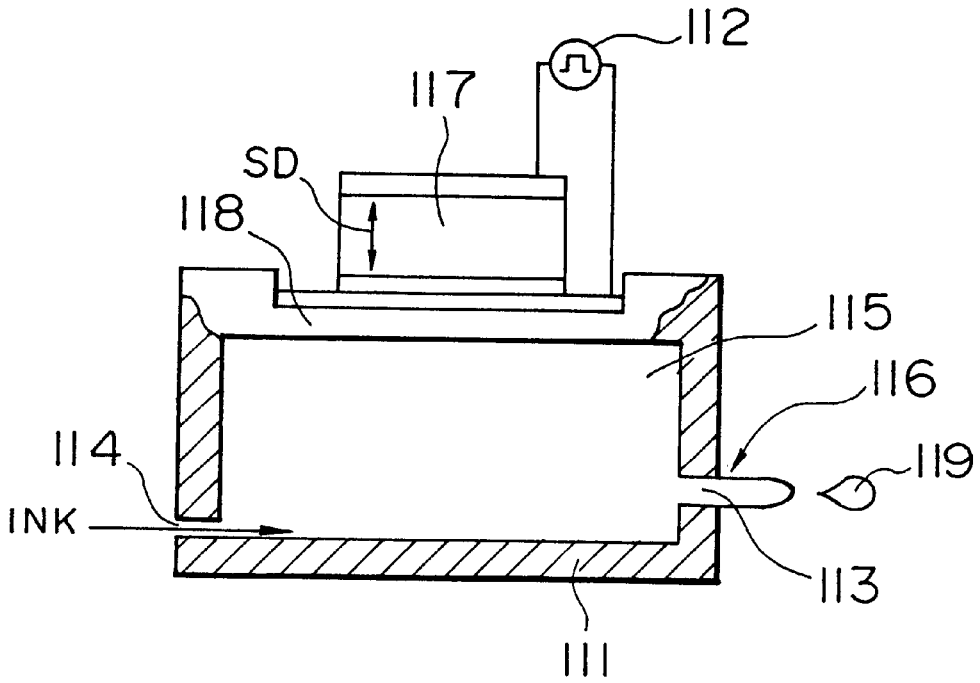
FIGS. 12A and 12B illustrate the construction of a printer head in terms of principle.
Figure 12B:
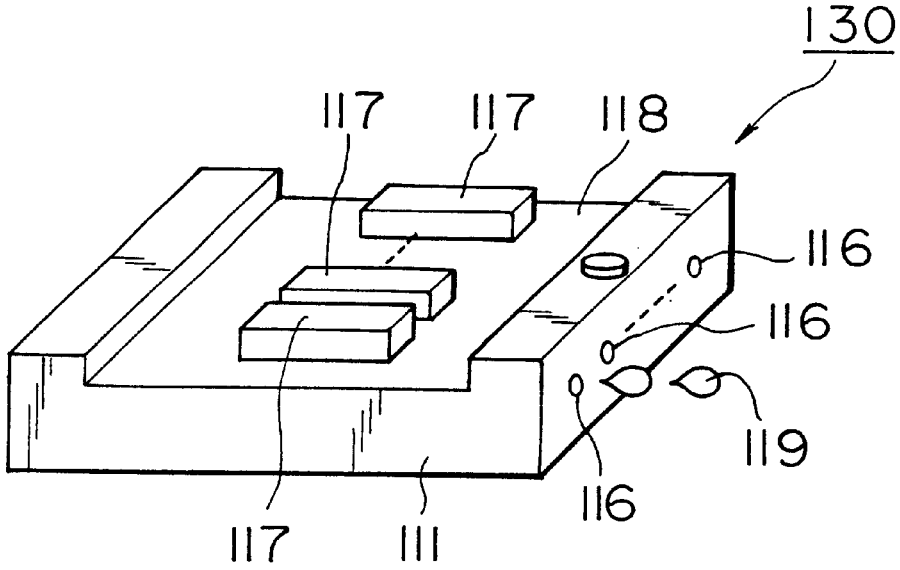

FIGS. 12A and 12B illustrate the construction of a printer head in terms of principle. In this printer head 130, a plate oscillator type structure is adopted in which a determined volume of ink is ejected from the nozzle.

As shown in FIG. 12A, the printer head 130 includes a flat type electrostrictive oscillator 117 adapted to displace in the directions indicated by arrows SD in the drawing and consisting of a piezoelectric ceramic material, an oscillation plate attached to the flat type electrostrictive oscillator 117, a nozzle unit 111 that is equipped with the electrostrictive oscillator 117 and the oscillation plate 118, an ink chamber 115 that is defined in the nozzle unit 111, an ink supply inlet 114 through which ink with which the ink chamber 115 is to be filled is supplied, a nozzle 116 and an orifice portion 113 for ejecting ink in the form of an ink droplet 119, and a voltage generator 112 for generating a voltage to be applied to the electrostrictive oscillator 117, wherein a voltage corresponding to printing data is generated from the voltage generator 112 and applied to the electrostrictive oscillator 117, whereby an ink droplet is ejected as a result of a variation in the volume of the ink chamber 115;

The printer head 130 has a multi-nozzle structure. As shown in FIG. 12B, m electrostrictive oscillators 117 are provided for m nozzles, and voltage is applied to the m electrostrictive oscillators 117, whereby ink droplets 119 are ejected from m orifice portions 113.

In the dot size modulation type ink jet printer, the nozzles are grouped as in the case of the carrier jet printer, and printing is performed by driving the electrostrictive oscillators 117 in dot units while performing scanning with the printer head 130 in the main scanning direction with respect to the recording paper 53, whereby it is possible to make any printing misregistration less conspicuous as in the above-described embodiment.

Further, it is also possible to make printing misregistration less conspicuous by making the ink dot size of the intermediate ejection larger than that of the ejection at the start and at the end.

In accordance with claim 1 of the present invention, there is provided a printing apparatus of the type in which scanning is performed with a printer head in a main scanning direction with respect to a printing material to thereby print an image, wherein N recording elements are arranged on the printer head in a sub-scanning direction at intervals of K dots such that K/N is an irreducible fraction, and wherein there is provided a grouping means which, when the above-mentioned recording elements are driven while effecting an interlaced scanning with the above-mentioned printer head for each predetermined dot interval, divides the above-mentioned recording elements into groups each consisting of recording elements driven with the same timing and determines the drive sequence for the groups such that the position on the above-mentioned recording material at which printing is effected by a predetermined recording element is, with respect to the main scanning direction, the same as or adjacent to the positions at which printing is effected by the recording elements that are arranged so as to be adjacent to that recording element with respect to the sub-scanning direction, whereby it is possible to make any printing misregistration less conspicuous when printing is executed on a time-division basis while performing scanning continuously with the printer head, thereby making it possible to prevent a deterioration in printing image quality.

In accordance with claim 2, there is provided a printing apparatus, wherein the above-mentioned printer head includes a plurality of recording heads and wherein the above-mentioned recording elements of cyan, magenta and yellow or those of cyan, magenta, yellow and black are arranged for each recording head, whereby it is possible to prevent a deterioration in printing image quality when color printing is performed.

In accordance with claim 3, there is provided a printing apparatus, wherein the above-mentioned grouping means effects the above-mentioned division into groups and determines the above-mentioned drive order such that the case is included in which the printing position for the above-mentioned predetermined recording element is close in the main scanning direction to the printing positions for the recording elements adjacent thereto in the sub-scanning direction to thereby perform printing in a variety of forms, whereby it is possible to make any printing misregistration less conspicuous.

In accordance with claim 4, there is provided a printing apparatus which is applicable to a two-liquid mixing type ink jet printer, wherein the above-mentioned recording elements includes ejection means for causing the above-mentioned mixed ink to be ejected from the above-mentioned nozzles and determining means for measuring a determined amount of the above-mentioned ink, whereby it is possible to prevent a deterioration in printing image quality when printing is effected in halftone.

In accordance with claim 5, there is provided a printing apparatus which is applicable to a head scanning type on-demand printing apparatus in which the above-mentioned printer head moves with respect to the above-mentioned recording material, whereby it is possible to prevent a deterioration in printing image quality when printing is effected by moving the printer head continuously.

In accordance with claim 6, there is provided a printing apparatus, wherein the above-mentioned recording elements are driven while the above-mentioned printer head makes forward and backward movements, whereby the printing apparatus is also applicable to the case in which the printer head reciprocates, thereby making it possible to prevent a deterioration in image quality while increasing the printing speed.

In accordance with claim 7 of the present invention, there is provided a printing method of the type in which scanning is performed with a printer head in a main scanning direction with respect to a printing material to thereby print an image, wherein N recording elements are arranged on the printer head in a sub-scanning direction at intervals of K dots such that K/N is an irreducible fraction, and wherein when the above-mentioned recording elements are driven while effecting an interlaced scanning with the above-mentioned printer head for each predetermined dot interval, the above-mentioned recording elements are divided into groups each consisting of recording heads driven with the same timing and the drive sequence for the groups is determined such that the position on the above-mentioned recording material at which printing is effected by a predetermined recording element is, with respect to the main scanning direction, the same as or adjacent to the positions at which printing is effected by the recording elements that are arranged so as to be adjacent to that recording element with respect to the sub-scanning direction, whereby it is possible to make any printing misregistration less conspicuous when printing is executed on a time-division basis while performing scanning continuously with the printer head, thereby making it possible to prevent a deterioration in printing image quality.

What is claimed is:

1. A printing apparatus having a printer head which scans a recording material in a main scanning direction to thereby print an image, said apparatus comprising:

N recording elements arranged on said printer head in a sub-scanning direction perpendicular to said main scanning direction at intervals of K dots such that K/N is an irreducible fraction, and a printer driving circuit operatively configured, programed and connected to said recording elements and said printer head;

wherein, when printing is executed by driving said recording elements while effecting an interlaced scanning with said printer head for each predetermined dot interval, said N recording elements are divided into groups by said printer driving circuit, each group consisting of recording elements driven with the same timing, and a drive sequence for said groups is determined by said printer driving circuit such that the printing positions sequential with respect to the sub-scanning direction for N recording elements form a ">" pattern on said recording material, and printing positions of recording elements of each of said groups being symmetric with respect to an axis of line of symmetry of the ">" pattern and printing with said same timing.

2. A printing apparatus according to claim 1, wherein said printer head includes a plurality of recording heads each of which includes recording elements of cyan, magenta and yellow or those of cyan, magenta, yellow and black are arranged on each recording head.

3. A printing apparatus according to claim 1, wherein said division into groups of said recording element is effected such that the printing position for said predetermined recording element is close in the main scanning direction to the printing positions for the recording elements adjacent thereto in the sub-scanning direction.

4. A printing apparatus according to claim 1, wherein said printing apparatus is a two-liquid mixing type ink jet printer in which ink and diluent are mixed together before being ejected, and wherein said recording elements included ejection means for causing said mixed ink to be ejected from said nozzles and measuring means for measuring said ink.

5. A printing apparatus according to claim 1, wherein said printing apparatus is a head scanning type on-demand printing apparatus in which said printer head moves in the main scanning direction with respect to said recording material.

6. A printing apparatus according to claim 5, wherein said recording elements are driven while said printer head makes forward and backward movements.

7. A printing method having a printer head which scans a recording material in a main scanning direction to thereby print an image, said method comprising the steps of:

providing N recording elements on the printer head and arranging the recording elements in a sub-scanning direction perpendicular to said main scanning direction at intervals of K dots such that K/N is an irreducible fraction, and operatively configuring and connecting a printer driving circuit to said recording elements wherein, when printing is executed by driving said recording elements while effecting an interlaced scanning with said printer head for each predetermined dot interval, said N recording elements are divided into groups by said printer driving circuit, each group consisting of recording elements driven with the same timing, and a drive sequence for the groups is determined by said printer driving circuit such that the printing positions sequential with respect to the sub-scanning direction for N recording elements form a ">" pattern on said recording material, and printing positions of recording elements of each of said groups being symmetric with respect to an axis of line of symmetry of the ">" pattern find printing with said same timing.

* * * * *